US008444237B2

(12) United States Patent
Kang et al.

(10) Patent No.: US 8,444,237 B2
(45) Date of Patent: May 21, 2013

(54) REFRIGERATOR WITH A DOOR OPENING APPARATUS

(75) Inventors: Byeong Gyu Kang, Gyeongsangnam-do (KR); Jeong Ho Shin, Gyeongsangnam-do (KR); Myung Hwan Kim, Gyeongsangnam-do (KR); Sang Bum Ha, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 467 days.

(21) Appl. No.: 12/690,229

(22) Filed: Jan. 20, 2010

(65) Prior Publication Data

US 2011/0016907 A1 Jan. 27, 2011

(30) Foreign Application Priority Data

Jul. 22, 2009 (KR) ..... 10-2009-0066701

(51) Int. Cl.
*A47B 96/00* (2006.01)

(52) U.S. Cl.
USPC ..... 312/405; 312/319.2

(58) Field of Classification Search
USPC ..... 312/401, 405, 405.1, 319.2, 326, 312/329, 296, 324; 62/265, 441, 449; 49/276, 49/277, 278, 279, 280
See application file for complete search history.

(56) References Cited

U.S. PATENT DOCUMENTS

| | | | | |
|---|---|---|---|---|
| 5,791,179 | A * | 8/1998 | Brask | 70/278.1 |
| 5,971,514 | A * | 10/1999 | Hayakawa | 312/319.2 |
| 5,988,709 | A * | 11/1999 | Lee et al. | 292/199 |
| 6,270,175 | B1 | 8/2001 | Sfeir | |
| 6,338,536 | B1 * | 1/2002 | Ueno et al. | 312/405 |
| 6,709,032 | B2 * | 3/2004 | Huang | 292/201 |
| 2005/0262868 | A1 * | 12/2005 | Jeong et al. | 62/408 |
| 2006/0097612 | A1 * | 5/2006 | Park | 312/405 |
| 2006/0107597 | A1 * | 5/2006 | Jin et al. | 49/149 |
| 2008/0083243 | A1 * | 4/2008 | Lee et al. | 62/446 |
| 2008/0100189 | A1 * | 5/2008 | Huber | 312/319.1 |
| 2011/0131884 | A1 * | 6/2011 | Herper et al. | 49/386 |

FOREIGN PATENT DOCUMENTS

| | | | |
|---|---|---|---|
| CN | 1461934 | A | 12/2003 |
| JP | 2005-127527 | A | 5/2005 |

OTHER PUBLICATIONS

Chinese Office Action dated Dec. 15, 2011 for Application No. 201010104079.4, with English Translation, 22 pages.

* cited by examiner

*Primary Examiner* — James O Hansen
*Assistant Examiner* — Sasha T Varghese
(74) *Attorney, Agent, or Firm* — Fish & Richardson P.C.

(57) ABSTRACT

A refrigerator of the embodiment includes a cabinet in which a storage chamber is formed; a door that is connected to the cabinet and opens and closes the storage chamber; and a door opening apparatus that is provided in the cabinet and opens the door, wherein the door opening apparatus includes: a push member that contacts a rear surface of the door and pushes the rear surface of the door by a rotation operation and a driver that is connected to the push member and generates power for moving the push member.

11 Claims, 7 Drawing Sheets

REFRIGERATOR WITH A DOOR OPENING APPARATUS

CROSS-REFERENCE TO RELATED APPLICATIONS

The present application claims priority under 35 U.S.C. 119 and 35 U.S.C. 365 to Korean Patent Application No. 10-2009-0066701 (filed on Jul. 22, 2009), which is hereby incorporated by reference in its entirety.

BACKGROUND OF THE INVENTION

The embodiment relates to a refrigerator.

The refrigerator includes a main body in which a storage chamber is formed and a door that is connected to the main body to open and close the storage chamber.

The door may be rotatably connected to the main body or slidably connected to the main body in a front and back direction.

The door or the main body is provided with a magnet to maintain a state where the doors are closed.

In order to open the door, a user pulls the door with a force larger than an attractive force by the magnet.

SUMMARY OF THE INVENTION

The present embodiment proposes a refrigerator.

A refrigerator according to one embodiment includes: a cabinet in which a storage chamber is formed; a door that is connected to the cabinet and opens and closes the storage chamber; and a door opening apparatus that is provided in the cabinet and opens the doors, wherein the door opening apparatus includes: a push member that contacts the rear surface of the door and pushes the rear surface of the door by a rotation operation and a driver that is connected to the push member and generates power for moving the push member.

A refrigerator according to another embodiment includes a cabinet in which a storage chamber is formed; a door that is connected to the cabinet and opens and closes the storage chamber; a driver that is operated by a signal input from the outside; and a push member that is connected to the driver, rotated with respect to a fixing shaft as a rotation center, wherein the push member contacts the rear surface of the door to push the door during the rotation operation of the push member.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Hereinafter, exemplary embodiments will be described in detail with reference to the accompanying drawings. The exemplary embodiments describe a side-by-side type refrigerator, by way of example, for convenience of understandings and explanation and can be applied to all the types of refrigerators including a refrigerator door.

Figure 1:
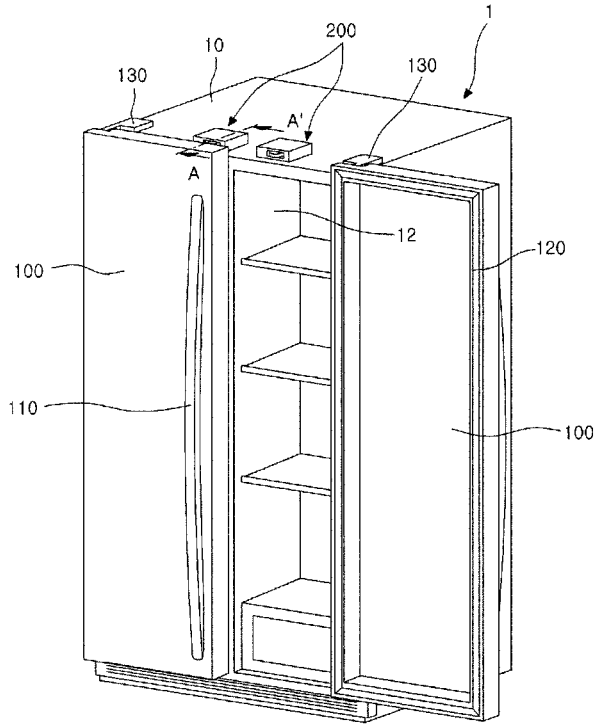
FIG. 1 is a perspective view of a refrigerator including a door opening apparatus according to a first embodiment.

FIG. 1 is a perspective view of a refrigerator including a door opening apparatus according to a first embodiment. Referring to FIG. 1, a refrigerator 1 according to the present embodiment includes a cabinet 10 that has a storage chamber formed therein and a door 100 that opens and closes the storage chamber.

The storage chamber in the cabinet 10 can be partitioned left and right by a barrier. A freezing chamber is positioned at a left side of the barrier 12 and a refrigerating chamber is positioned at the right of the barrier 12.

The door 100 may include a refrigerating chamber door that opens and closes the refrigerating chamber and a freezing chamber door that opens and closes the freezing chamber. Each door is rotatably connected to the cabinet 100 by a hinge 130.

In the present embodiment, the refrigerating chamber door and the freezing chamber door are referred to a door. The front surface of the door 100 is provided with a door handle 110 that is held by a user in order to open the door 100 and may further include a dispenser that draws out water or ice or a home bar that draws in and out frequently used foods, if necessary, etc.

A gasket 120 may be provided at an outer circumference of the rear surface of the door 100. The gasket 120 is configured to be closely attached to the front surface of the cabinet 10 and the inside of the gasket 120 is provided with a magnet (see 122 of FIG. 3). Therefore, when the door 100 closes the storage chamber, the gasket 120 can be closely attached to the cabinet 10.

Meanwhile, the upper end of the door 100 is configured to be positioned at the upper side than the upper surface of the cabinet 10 and the upper surface of the cabinet 10 is provided with a door opening apparatus 200 that opens the door 100. The door opening apparatus 200 pushes the upper part of the door 100 to help the opening of the door 100.

Although the present invention describes, by way of example, the case that the door opening apparatus 200 is provided at the upper surface of the cabinet 10, the door opening apparatus 200 may be positioned at the inside of the cabinet 10, that is, at the storage chamber.

At this time, the upper part of the door 100, which contacts the door opening apparatus 200, may be the door 100 itself or a door deco that is connected to the upper side of the door 100.

The door opening apparatus 200, which is mounted at the upper surface of the cabinet 10, is provided by a number corresponding to the door 100 and is positioned to be spaced from the hinge 130.

At this time, the door opening apparatus 200 may be installed at a position where the spaced distance from the hinge 130 is largest in the range that can push the door 100, so that it is easy to easily open the door 100 by the door opening apparatus 200.

Figure 2:
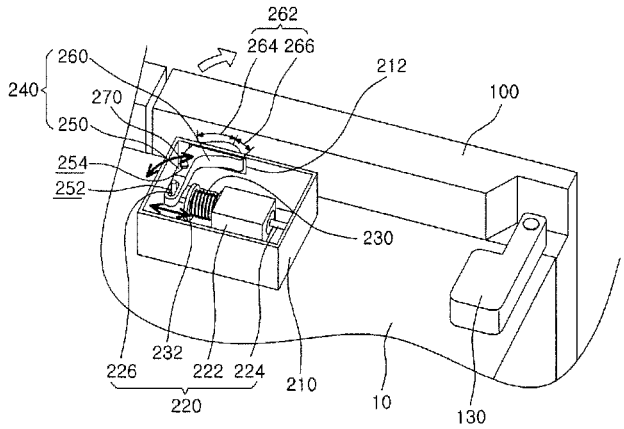
FIG. 2 is a partial perspective view of a refrigerator including a door opening apparatus according to a first embodiment.
Figure 3:
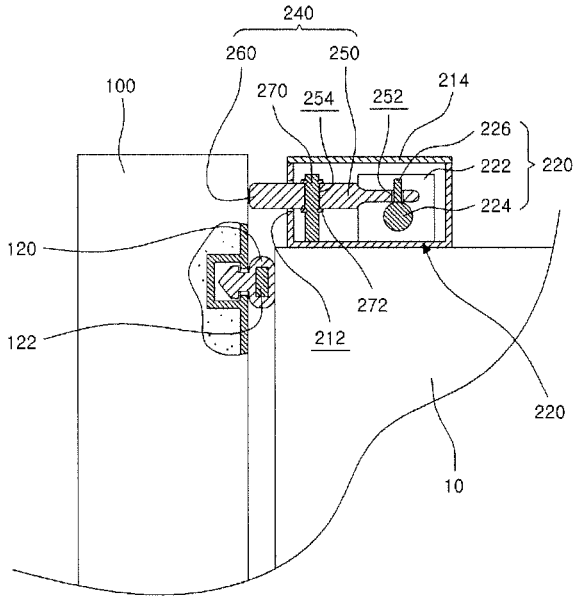
FIG. 3 is a cross-sectional view taken along line A-A of FIG. 1.

FIG. 2 is a partial perspective view of the refrigerator including the door opening apparatus according to the first embodiment and FIG. 3 is a cross-sectional view taken along line A-A' of FIG. 1.

Referring to FIGS. 2 and 3, the door opening apparatus 200 can be provided at a front side of the upper surface of the cabinet 10 and open the door 100 by pushing the rear surface of the door 100.

In detail, the door opening apparatus 200 includes a case 210, a solenoid unit 220 that is driven by application of power, a push member 240 that pushes the door 100, a connection shaft 226 and a fixing shaft 270 that operate the push member 240, and an elastic member 230 that returns the positions of the push member 240 and the solenoid unit 220.

The case 210 forms an external appearance of the door opening apparatus 200. The case 210 is formed with a space that receives the solenoid unit 200 and the push member 240, etc. The front surface of the case 210 is provided with an opening part 212 through which the push member 240 passes. The upper surface of the case 210 is formed to be opened and is covered by a case cover 214.

The solenoid unit 220 includes a coil member 222 to which a plurality of coils are wound and a rod 224 that is disposed to penetrate through the coil member 222 in a shaft direction.

The solenoid unit 220 provides power that moves the push member 240 and may be referred to as a driver.

The coil member 222 may be covered by a coil cover. The rod 224 is formed to be extended in a parallel direction to the left and right direction of the door 100 and is linearly moved in the left and right direction of the door.

The rod 224 is extended to both sides of the coil part 222 by penetrating through the coil member 222 and one end thereof is connected to the push member 240. The end of the rod 224, which is connected to the push member 240, is formed with the connection shaft 226. The connection shaft 226 is formed to be extended in one side direction from the end of the rod 224 and penetrates through the push member 240.

The outer side of the rod 224 is provided with the elastic member 230. The elastic member 230, which is a coil spring, is compressed when it is moved in one direction of the rod 224. The rod 224 and the push member 240, which is connected to the rod 224, can be returned to an original position by the restoring force of the elastic member 230.

The rod 224 is provided with an elastic member seating part 232 to which the elastic member 230 is seated. The elastic member seating member 232 can be seated with one end of the elastic member 230. It can be protruded in the outer side direction from the outer circumferential surface.

The elastic member seating part 232 may be molded together with the rod 224 and is molded with a separate member and can be then connected to the rod 224.

One end of the elastic member 230 contacts the elastic member seating part 232 in the state where the elastic member 230 is mounted on the elastic member seating part 232 and the opposite end thereof contacts the coil cover. Therefore, when power is applied to the coil member 222 so that the rod 224 is moved in one direction, the elastic member seating part 232 is also moved together, making it possible to compress the elastic member 230.

Meanwhile, the push member 240, which assists the opening of the door, is rotated by interworking with the movement of the rod 224, to push the door 100 by the rotation operation.

In detail, the push member 240 has a bent shape such as an approximately 'ㄱ' letter shape when being viewed from the upper side. The push member 240 includes a connection part 250 that is connected to the rod 224 and a push part 260 that contacts the door 100.

The connection part 250 is connected to the connection shaft 226 of the rod 226 so that it is substantially orthogonal to the rod and the push part 260 is extended to be rounded at the end of the connection part 250. The rotation radius of the push member 240 can be controlled according to the moving distance of the rod 224, based on a length of the connection part 250.

One side of the connection part 250 is formed with a connection hole 252 that penetrates though the connection shaft 226. The connection hole 252 is formed in a form of a long hole according to the longitudinal direction of the connection part 250. Therefore, the push member 240 is rotated while the connection shaft 226 is moved along the connection hole 252 in the linear motion of the rod 224.

Meanwhile, the other side of the connection part 250 is provided with a fixing hole 254 through which the fixing shaft 270 penetrates through. The fixing hole 254 is formed at a position that is spaced to the contact 260 side from the connection hole 252.

The fixing hole 254 is inserted with the fixing shaft 270 and the fixing shaft 270 is fixed to the bottom surface of the case 210 or the upper surface of the cabinet 10. FIG. 3 shows an example that the fixing shaft 270 is fixed to the bottom surface of the case 210.

The push member 240 can be rotated with respect to the fixing shaft 270 as a rotation center. The fixing shaft 270 is connected with the fixing unit 272 that maintains a state where the push member 240 is connected to the fixing shaft 270. The fixing unit 272 is connected to the fixing shaft 270 at the upper side and the lower side of the push member 240.

The up and down movement of the push member 240 can be prevented by the fixing unit 272 so that the push member 240 is separated from the connection shaft 226.

The contact part 260 pushes the door 100 when the push member 240 is rotated. The contact part 260 is extended to be rounded in a side direction from the connection part 250. A surface adjacent to the door in the contact part 260 is formed to be rounded.

Figure 4:
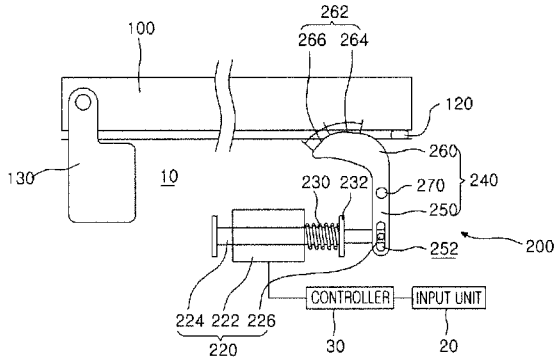
FIGS. 4 and 5 are diagrams showing a door opening operation by the door opening apparatus according to the first embodiment.
Figure 5:
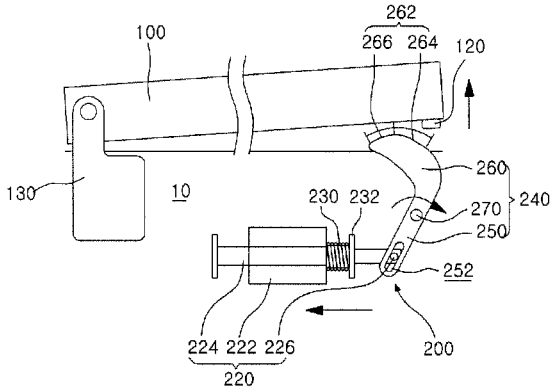

In other words, the contact part 260 includes a round part 262 that has a curved surface. The round part 262 can softly open the door without suddenly opening the door 100. FIGS. 4 and 5 are diagrams showing a door opening operation by the door opening apparatus according to the first embodiment.

Referring to FIGS. 4 and 5, the round part 262 of the push member 240 can be divided into a plurality of portions having a different curvature.

In detail, the round part 262 includes a first part 264 that contacts the rear surface of the door 100 when the door is rotated by a first angle in the state where the door 100 is closed and a second part 266 that contacts the rear surface of the door 100 when the door 100 is rotated a first angle or more.

The first part 264 can contact the rear surface of the door 100 immediately before the gasket 120 is separated from the cabinet 10.

In the present embodiment, the curvature of the second part 266 can be formed larger than the curvature of the first part 266.

The first part 264 first contacts the rear of the door 100 and then, the second part 266 contacts the rear surface of the door 100.

The curvature of the first part 264 and the second part 266 is different from each other, such that they are rapidly rotated at the early stage of a rotation of the door 100 and after the cabinet 10 and the gasket 120 are separated from each other, the door 100 is opened at a relatively slow speed.

Although the present embodiment describes an example where the round part 262 is divided into two portions, the round part 262 can be divided into more than three portions. Hereinafter, a door opening process will be described with reference to FIGS. 1 to 5.

First, the user holds the door handle 110 in order to open the door 100. When the door handle 100 is held, the opening signal of the door 100 is input by the input unit 20 that is provided at the door 100 or the door handle 110. When the opening signal of the door 100 is input by the input unit 20, a controller 30 operates the door opening apparatus 200.

The input unit 20 may be a sensor that can sense the holding of the door handle 110, a button switch that can be directly operated by the user, or a sensor that senses the approach of the user, etc. It is to be noted that a type of the input unit 20 is not limited in the present embodiment.

When the opening signal of the door 100 is input by the input unit 20 immediately before the door 100 is opened or at an instant that the door 100 is opened, power is applied to the solenoid unit 220. The coil member 222 is formed with magnetic field and the rod 224 is linearly moved. The rod is moved to the left (when being viewed from FIG. 4) and the elastic member 230 is compressed according to the movement of the rod 224. That is, the rod 224 pulls the push member 250.

The push member 240 can be rotated clockwise with respect to the fixing shaft 270 as a rotation center. Since the connection shaft 226 is linearly moved and the push member 240 is rotated, the connection shaft 226 is moved along the connection hole 252 in order to smoothly rotate the push member 240.

Meanwhile, when the push member 240 is rotated, the door 100 is gradually pushed in the state where the round part 262 of the push member 240 contacts the door 100, thereby making it possible to open the door 100.

At the early stage where the rotation of the push member 240 starts, the first part 264 contacts the rear surface of the door 100 as shown in FIG. 4 and the portion that contacts the rear surface of the door is different in the process where the door 100 is rotated.

When the push member 240 is continuously rotated by the movement of the rod 224, the push member 240 continuously pushes the door 100, such that the gasket 120 of the door 100 is separated from the cabinet 10. At this time, the door 100 is positioned at an end of the first part 264.

In the state where the gasket 120 is separated from the cabinet 10, the rear surface of the door 100 contacts the second part 266 of the push member 240 and the door 100 is rotated in the state where it contacts the second part 266 by the rotation of the push member 240.

At this time, since the second part 266 has a curvature larger than the first part 264, the opening speed of the door is slow when the second part contacts the rear surface of the door than when the first part contacts the rear surface of the door.

In other words, in the state where the gasket 120 is separated from the cabinet 10, the door 100 can be opened at a stable speed without being suddenly opened.

Meanwhile, the door opening apparatus 200 can be performed together with the operation that the user holds and pulls the door handle 100. The door 100 is rotated by a predetermined angle by the door opening apparatus 200 and can be easily rotated in the state where the gasket 120 is separated from the cabinet 100, such that the user can rotate the door 100 with a small force in the state where he/she holds the door handle 110.

The door opening apparatus 200 is operated for a predetermined time and then, cannot be supplied with power. At this time, if power, which is applied to the solenoid unit 220, is not interrupted, the rod 224 is returned to an initial position by the restoring force of the elastic member 230 that is compressed by the movement of the rod 224.

The push member 240, which is connected to the road 224, is rotated at an original position counterclockwise while the rod 224 is moved.

Figure 6:
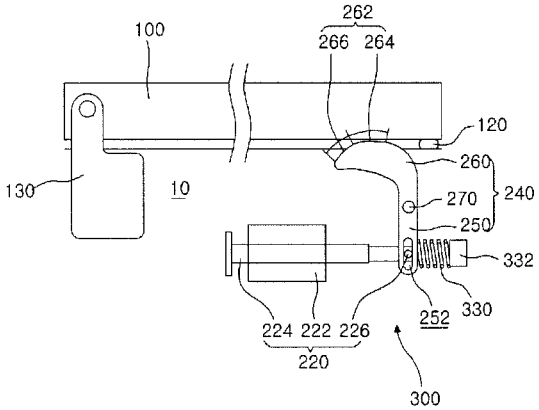
FIGS. 6 and 7 are diagrams showing a door opening operation by a door opening apparatus according to a second embodiment.
Figure 7:
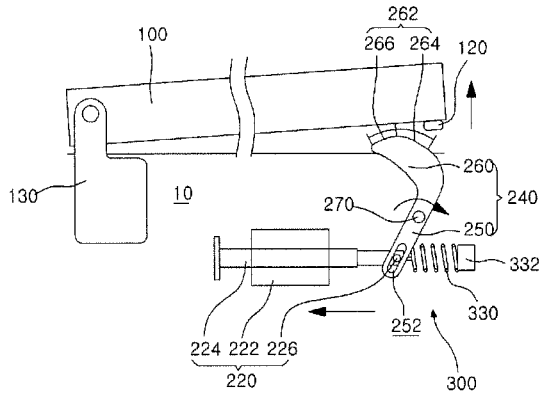

FIGS. 6 and 7 are diagrams showing a door opening operation by a door opening apparatus according to a second embodiment.

The second embodiment is the same as the first embodiment, but has a difference only in the position of the elastic member. Therefore, only the specific portions of the embodiment will be described and the same configuration as the first embodiment uses the same reference numeral and the detailed description thereof will be omitted.

Referring to FIGS. 6 and 7, a door opening apparatus 300 according to the present embodiment includes a solenoid unit 220 that includes the coil member 222 and the rod 224, a push member 240 that is shaft-connected by the rod 224 and the connection shaft 226 and rotatably provided by the fixing shaft 270, and an elastic member 330 that provides an elastic force so that the push member 240 and the rod 224 can be returned to an original position.

The elastic member 330 is fixed to a fixing part 332 that is provided at the cabinet 10 or one side of the case 210 and the other end thereof can be fixed to the connection part 250 of the push member 240. The elastic member 330 is configured of a coil spring and is tensioned according to the clockwise rotation of the push member 240.

Therefore, when power is applied to the solenoid unit 220 such that the rod 224 is linearly moved in the left direction (when being viewed from FIG. 6), the push member 240 is rotated clockwise with respect to the fixing shaft as a rotation center and the elastic member 330 is tensioned according to the rotation of the push member 240.

Figure 8:
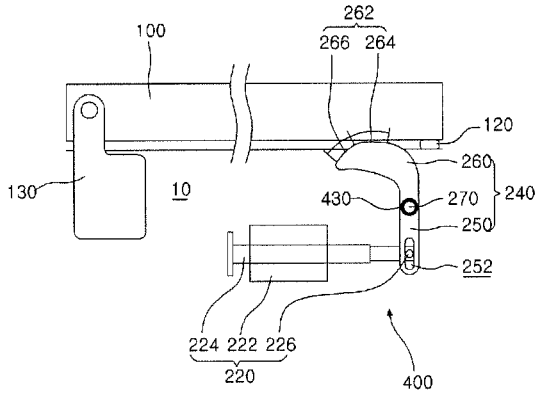
FIGS. 8 and 9 are diagrams showing a door opening operation by the door opening apparatus according to a third embodiment.
Figure 9:
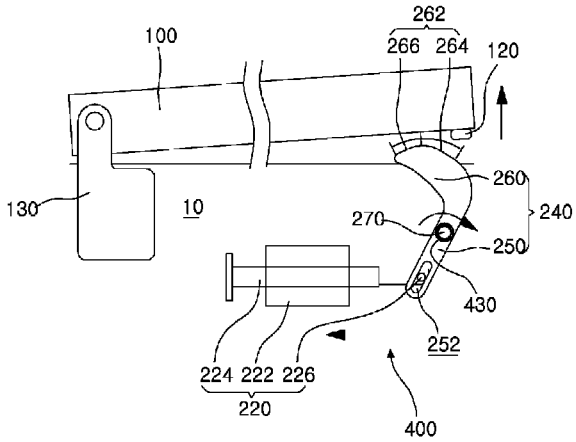

FIGS. 8 and 9 are diagrams showing a door opening operation by a door opening apparatus according to a third embodiment.

The third embodiment is the same as the above embodiments and has a difference only in the position and type of the elastic member. Therefore, only the specific portions of the embodiment will be described and the same configuration as the first embodiment of the embodiments uses the same reference numeral and the detailed description thereof will be omitted.

Referring to FIGS. 8 and 9, a torsion spring, which provides a torsional elastic force, is applied as an elastic member 430 of the door opening apparatus 400 according to the third embodiment.

The elastic member 430 can be wound at the circumference of the fixing shaft 270. One end of the elastic member 430 can be fixed to the push member 240 and the other end thereof can be fixed to the case 210 or the fixing shaft 270.

Figure 10:
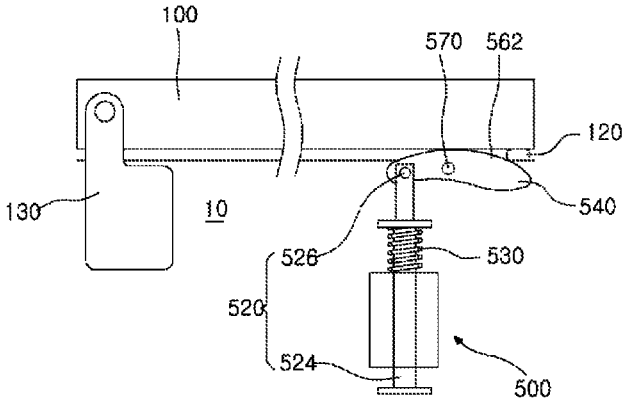
FIGS. 10 and 11 are diagrams showing a door opening operation by a door opening apparatus according to a fourth embodiment.
Figure 11:
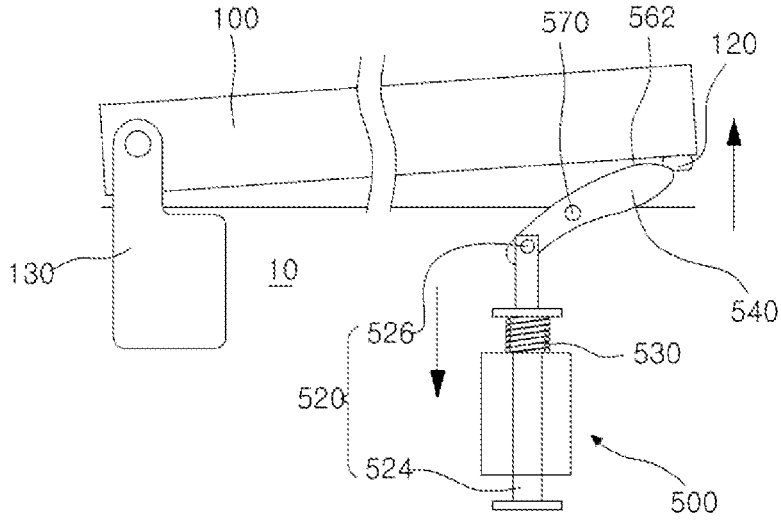

FIGS. 10 and 11 are diagrams showing a door opening operation by a door opening apparatus according to a fourth embodiment.

The fourth embodiment is the same as the above embodiments and has a difference only in the moving direction of the rod. Therefore, only the specific portion of the embodiment will be described and the same configuration as the first embodiment of the embodiments uses the same reference numeral and the detailed description thereof will be omitted.

Referring to FIGS. 10 and 11, a refrigerator door opening apparatus 500 according to the fourth embodiment includes a solenoid unit 520 that is driven by application of power, a push member that presses and opens the door 100, a connection shaft 526 and a fixing shaft 570 that operate the push member 540, and an elastic member 530 that returns the push member 540 and the solenoid unit 520 to an original position.

In detail, the rod 524 is linearly moved in a direction (or a front and back direction of the cabinet 10) intersected with the rear surface of the door 100.

The end of the rod 524 is formed with the connection shaft 526 and the connection shaft 526 is connected to the push member 540.

The rod 524 is provided with the elastic member 530. In FIG. 10, the elastic member and the elastic member seating structure (fixing structure) in the same scheme as the first embodiment is shown but the elastic member and the elastic member seating structure (fixing structure) in the same scheme as the second embodiment or the third embodiment can be applied.

The push member 540 can be rotated by the fixing shaft 570 and the push member 540 includes a round part 562 that is rounded. The round part 562 has the same structure as the structure described in the first embodiment and performs the same function and therefore, the detailed description thereof will be omitted.

With the proposed embodiments, the round part is formed at the push member to contact the round part to the rear surface of the door, such that the contact part of the push member, which contacts the rear surface of the door in the process of opening the door, is varied, thereby making it possible to softly open the door.

In addition, the plurality of portions of the round part are formed at the different curvature to rapidly rotate the door when the door is initially opened and to reduce the opening speed of the door in the state where the door is rotated at a predetermined angle, such that the user can use a smaller force at the early state of opening the door and improve the opening operation feeling of the door during the opening of the door.

In other words, the rotation speed of the door is reduced in the state where the door is rotated at predetermined angle, thereby making it possible to prevent the door from suddenly opening.

What is claimed is:

1. A refrigerator comprising:

a cabinet in which a storage chamber is formed;

a door that is connected to the cabinet and opens and closes the storage chamber; and a door opening apparatus that is provided in the cabinet and opens the door, wherein the door opening apparatus includes:

a push member that contacts a rear surface of the door and pushes the rear surface of the door by a rotation operation and a driver that is connected to the push member and generates power for moving the push member, wherein the push member is provided with a contact part that contacts the rear surface of the door, and the contact part has a round part, wherein the round part includes a plurality of portions that are formed with different curvatures, and the plurality of portions sequentially contact the rear surface of the door during the opening of the door, wherein the curvature of the portion which first contacts the door is smaller than the curvature of the portion that contacts the door later, among the plurality of portions, wherein the push member is rotatably coupled to a fixing shaft, wherein the driver is a solenoid unit that includes a rod that is linearly moved when electricity is conducted, and is directly connected to an end of the push member that is spaced apart from the fixing shaft, wherein the rod includes a connection shaft that is connected to the push member, wherein the connection shaft is connected to the push member at a position where it is spaced from the fixing shaft, wherein the push member has a connection hole to which the connection shaft is connected, and wherein the connection hole is elongated so that the connection shaft is moved along the connection hole during the rotation of the push member.

2. The refrigerator according to claim 1, wherein the push member further includes a connection part that is bent at the round part and is connected to the driver.

3. The refrigerator according to claim 1, wherein the rod pulls one end of the push member during the opening of the door.

4. The refrigerator according to claim 1, further comprising an elastic member that returns the rod to an original position in a state where the rod is linearly moved in one direction.

5. The refrigerator according to claim 4, wherein one end of the elastic member contacts the rod to elastically support the rod.

6. The refrigerator according to claim 4, wherein one end of the elastic member contacts the push member to elastically support the push member.

7. The refrigerator according to claim 4, wherein the elastic member is a torsion spring that is fixed at the fixing shaft providing the rotation center of the push member to elastically support the push member.

8. The refrigerator according to claim 1, wherein the plurality of portions that are formed with different curvatures comprise more than three portions that are formed with different curvatures.

9. The refrigerator according to claim 1, wherein the plurality of portions that are formed with different curvatures comprise:

a first portion that contacts the rear surface of the door throughout rotation of the door by the door opening apparatus from a state in which the door is closed to a state in which the door is rotated to a first angle; and a second portion that contacts the rear surface of the door at a point when the door opening apparatus rotates the door to the first angle and continues to contact the rear surface of the door as the door opening apparatus rotates the door further than the first angle, the curvature of the second portion being larger than the curvature of the first portion.

10. The refrigerator according to claim 9, further comprising:

a gasket that is provided at an outer circumference of the rear surface of the door and that is configured to contact a front surface of the cabinet in the state in which the door is closed, wherein, during rotation, by the door opening apparatus, of the door from the state in which the door is closed, the first portion contacts the rear surface of the door before the gasket is separated from the cabinet.

11. The refrigerator according to claim 10, wherein the curvature of the first portion and the curvature of the second portion are configured to cause the door opening apparatus to rotate the door at a first speed at an early stage of rotation of the door and, after the gasket is separated from the cabinet, rotate the door at a second speed that is slower than the first speed.

* * * * *